US005507592A

United States Patent [19]

McConnell

[11] Patent Number: 5,507,592

[45] Date of Patent: Apr. 16, 1996

[54] ARCED TROWEL

[76] Inventor: Joseph E. McConnell, 35 Sherbrook Rd., North Dartmouth, Mass. 02747

[21] Appl. No.: 301,184

[22] Filed: Sep. 6, 1994

Related U.S. Application Data

[63] Continuation of Ser. No. 162,233, Dec. 6, 1993, abandoned, which is a continuation of Ser. No. 925,103, Aug. 6, 1992, abandoned.

[51] Int. Cl.[6] ..... E01C 19/52; A01J 21/04

[52] U.S. Cl. ..... 404/99; 425/425

[58] Field of Search ..... 404/101, 105, 404/118, 96–99; 52/259, 329; 425/425, DIG. 38, DIG. 121, DIG. 125, 375, 256, 259, 6, 10, 12

[56] References Cited

U.S. PATENT DOCUMENTS

| | | | |
|---|---|---|---|
| 109,073 | 11/1870 | Streeter | 404/97 X |
| 818,416 | 4/1906 | Connelly | 404/97 |
| 872,903 | 5/1907 | Connelly | 404/97 X |
| 978,631 | 12/1910 | Olsen | 404/97 |
| 3,341,878 | 9/1967 | Hubbard | 404/97 X |
| 4,199,541 | 4/1980 | McFarland | 404/98 X |

*Primary Examiner*—Stephen G. Pellegrino
*Assistant Examiner*—Nancy Mulcare

[57] ABSTRACT

This is a cement applicator which lays a course of cement or mortar on a cement block without losing any of the cement in the apertures of the block. It comprises a semicircular trough having a handle centrally positioned on it external surface and which is charged with cement and then inverted over the area on which the operator wishes to lay a course of cement.

1 Claim, 2 Drawing Sheets

ARCED TROWEL

This is a Continuation of Ser. No. 07/162,233, filed Dec. 6, 1993, now abandoned, which is a Continuation of co-pending application Ser. No. 07/925,103 filed on Aug. 6, 1992, now abandoned.

SUMMARY OF THE INVENTION

The invention is directed at a cement applicator which lays a course of cement or mortar on a cement block without losing any of the cement in the apertures of the block. It comprises a semicircular trough which is filled with the cement and then inverted over the area on which the operator wishes to deposit the cement.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 1:
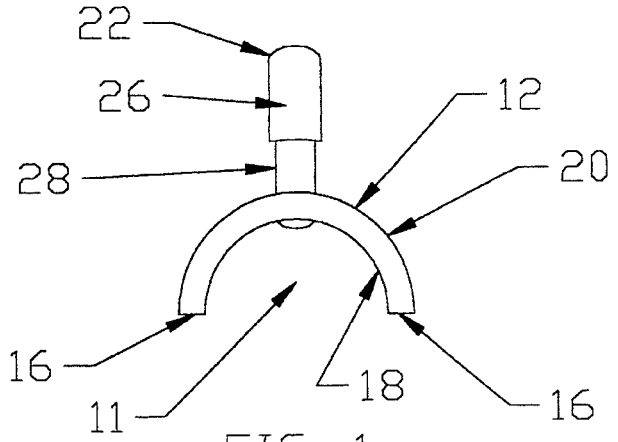
FIG. 1 is a side elevational view of a cement applicator according to the present invention.
Figure 2:
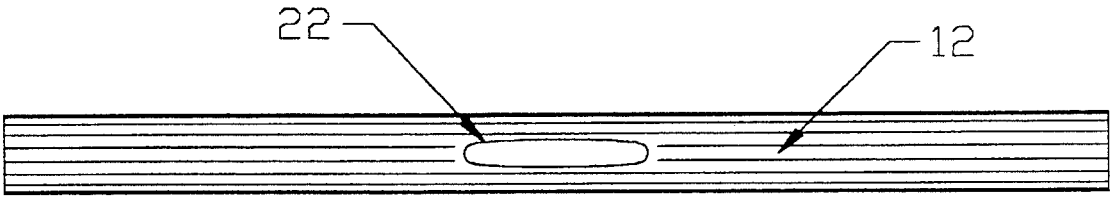
FIG. 2 is a top plan view of the cement applicator shown in FIG. 1.
Figure 3:
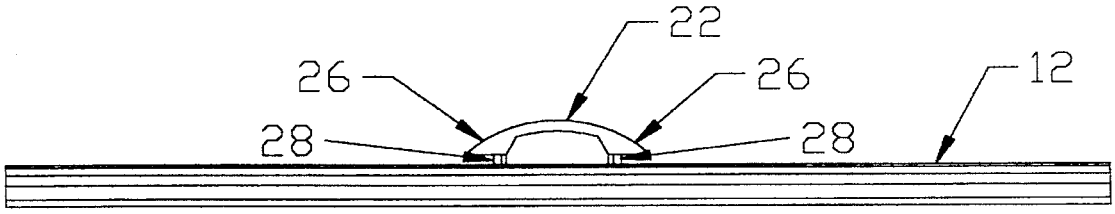
FIG. 3 is a front elevational view of the cement applicator shown in FIG. 1.
Figure 4:
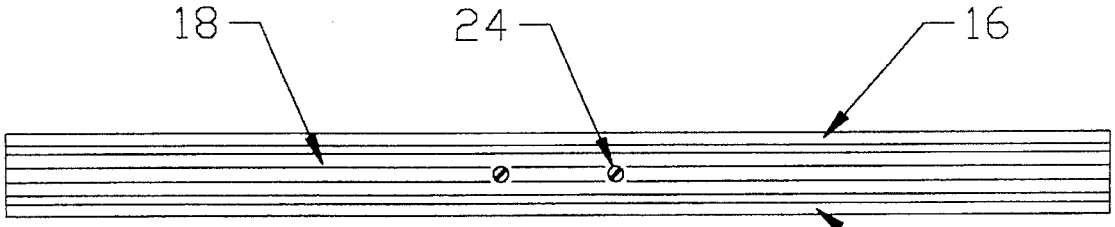
FIG. 4 is a bottom plan view of the cement applicator shown in FIG. 1.
Figure 5:
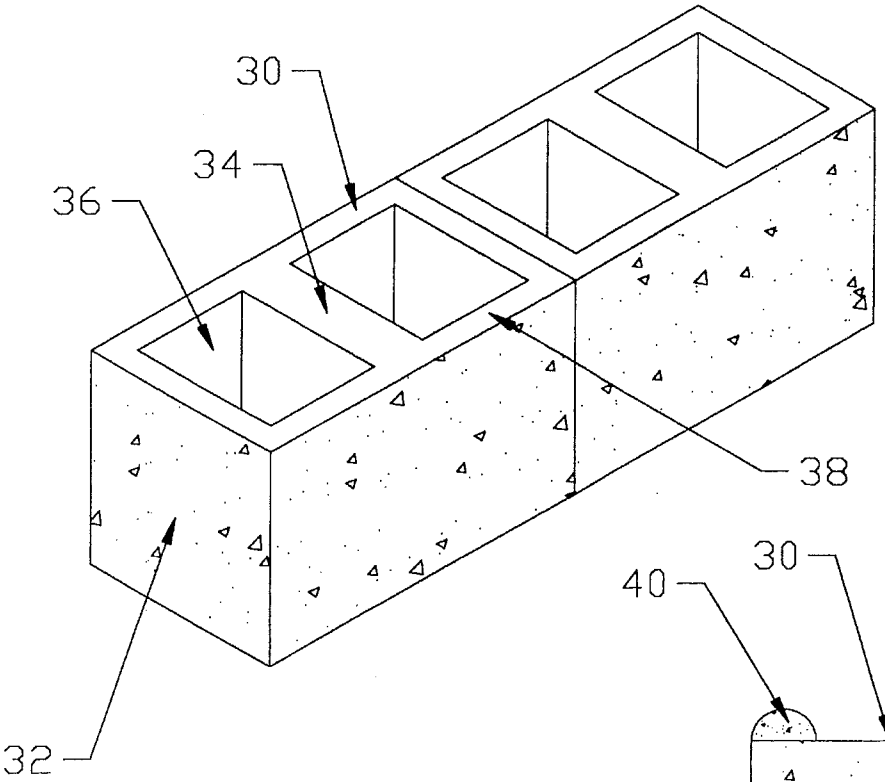
FIG. 5 is a perspective of a pair of cement blocks with which the cement applicator shown in FIG. 1 is used.
Figure 6:
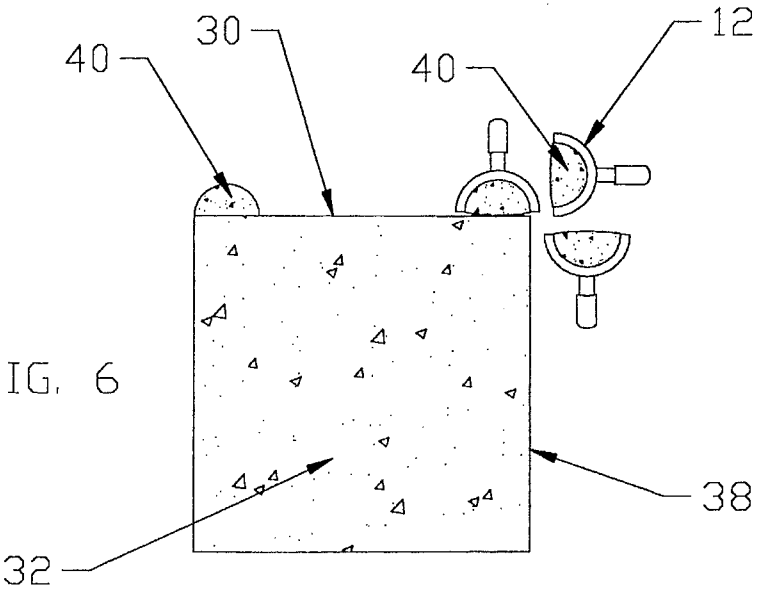
FIG. 6 is a side elevational view of the pair of cement blocks shown in FIG. 5 indicating on the right side the application of cement by the cement applicator shown in FIG. 1 and on the left side indicating the position of the cement after application.

There is shown in the drawings a cement or mortar applicator 10 having a channel like body portion 12. The body portion 12 is formed by cutting a piece of plastic pipe in half longitudinally providing the arced configuration. The body portion 12 is arced providing a trough 11 and terminates in two extended edges 16 as shown in FIG. 1. The extended edges 16 are in spaced parallel relationship with each other. The body portion 12 has an inner surface 18, which defines the trough 11, and an outer surface 20 as shown in FIG. 1. The trough 11 has a depth of 0.75 inches and is 1.5 inches wide at the opening. A handle 22 is fixed on the outer surface 20 of the body portion 12 at the center of the length of the body portion 12 and of the arc thereof. The handle may be bolted to the body portion 12 by forming two spaced through holes 24, passing bolts (not shown) through the holes 24 to engage the terminal ends 26 of the handle 22. Each of the terminal ends 26 of the handle 22 includes an internally threaded aperture 28. Each of the internally threaded apertures 28 is engaged by one of the bolts.

The cement applicator 10 is utilized in applying two parallel rows of wet mortar to the upper surface 30 of a concrete block 32. Concrete blocks are frequently formed of a series of partitions 34 which are joined at their ends by side partitions 38. In use, the openings 36 formed by the petitions 34 are placed in right angle relation to the surface on which the concrete block 32 is to be used, as is the side partitions 38. The mortar needs to be applied to the upper surface 30 so that the next course of concrete block can be laid. The present method uses a trowel to butter the upper surface 30 causing a large amount of the mortar to fall into the openings 36. The mortar which falls into the openings 36 is wasted leading to increase cost when concrete block 32 is utilized. When the inventor's cement applicator 10 is utilized, two parallel rows of mortar can be laid on the side partitions 38 with very little spillage into the openings 36. This is accomplished by charging (placing in) the trough 11 of the body portion 12 with mortar up to the edges 16. The distance between the edges 16 is approximately equal to the width of one side partition 38. Using the handle to hold the charged cement applicator 10, it is gently inverted over the upper surface 30 of a concrete block 32 on the length of one of the side partitions 38 laying the mortar 40 thereon. The cement applicator 10 is again charged and then it is inverted over the upper surface 30 of the same concrete block 32 on the length of the other side partition 38 laying the mortar 40 on that partition. The block 32 is now ready for the next course to be laid.

What I claim is:

1. The method of applying a charge of cement to a concrete block using a cement applicator, a charge of cement, the concrete block having a first long edge and a second long edge, the first long edge having a first upper edge and the second long edge having a second upper edge, the first and second long edges in spaced parallel relation to each other, the cement applicator having a body portion defining a trough, the trough including a unitary, arced wall having two long edges each terminating in two short edges, the short edges in spaced parallel relationship with each other, the body portion having an outer surface, a handle fixed on the outer surface of the body portion the steps comprising charging the trough of the body portion with cement up to the long edges, using the handle to hold the charged cement applicator, inverting the body portion over the first upper edge of a concrete block laying a course of cement thereon.

* * * * *